US005582128A

United States Patent [19]

Wollan et al.

[11] Patent Number: 5,582,128

[45] Date of Patent: Dec. 10, 1996

[54] TEAM GAME PLAY-BY-PLAY STRATEGY INDICATOR

[75] Inventors: Donald N. Wollan, San Antonio, Tex.; John G. Pennant-Jones, Oceanside, Calif.; Paul J. Dostart, La Jolla, Calif.; Henri J. A. Charmasson, San Diego, Calif.

[73] Assignee: Wollan, Pennant-Jones, & Dostart, San Diego, Calif.

[21] Appl. No.: 276,046

[22] Filed: Jul. 14, 1994

[51] Int. Cl.[6] ..... G09F 11/18

[52] U.S. Cl. ..... 116/225; 116/321

[58] Field of Search ..... 116/222, 223, 116/224, 225, 308, 316, 318, 321, 323; 434/247, 248, 251, 252, 257; 235/78 R, 78 G, 83, 88 G, 114, 115, 116, 122, 78

[56] References Cited

U.S. PATENT DOCUMENTS

| | | | |
|---|---|---|---|
| 1,728,584 | 9/1929 | Wright | 235/78 R |
| 2,359,253 | 9/1944 | Silano | 116/225 X |
| 2,993,288 | 7/1961 | Rothman | 166/223 |
| 3,006,315 | 10/1961 | Rothman | 116/223 |
| 3,105,688 | 10/1963 | Gray | 116/223 X |
| 3,313,045 | 4/1967 | Cummins | 434/251 |
| 5,398,418 | 3/1995 | Jones | 116/225 X |

OTHER PUBLICATIONS

Ready Play Little League & Tee Ball Trainer Jan., 1993.

*Primary Examiner*—William A. Cuchlinski, Jr
*Assistant Examiner*—Willie Morris Worth
*Attorney, Agent, or Firm*—Henri J. A. Charmasson; John D. Buchaca

[57] ABSTRACT

A hand-operated device in the form of a slide rule or disk computer for giving play-by-play instructions about the most appropriate next move in a team game, based upon the current status or position of the players and other game conditions. The device comprises a stationary frame with at least two sets of windows through which markings on a slidable or rotatable member can be displayed. A first set of windows is used to dial the position or the roles of the players or of a team on the field such as the loading of the bases in a baseball game. A second set of windows displays one or more instructions about the recommended next move. A plurality of movable members may be used in connection with the same frame, each member corresponding to a player's or team's role or position.

6 Claims, 1 Drawing Sheet

TEAM GAME PLAY-BY-PLAY STRATEGY INDICATOR

FIELD OF THE INVENTION

This invention relates to hand-operated information display devices such as slide rules, aviation computers and other such apparatuses used to quickly and conveniently display information based upon given criteria or conditions. More specifically, the invention relates to charts and guides for instantly providing instructions about the most appropriate next move in a team game based upon a particular set of circumstances such as player positions, status and other pertinent aspects of the game.

BACKGROUND OF THE INVENTION

As some team sports such as baseball have developed into highly specialized professional games, managers and players have evolved complex strategies. Most spectators are unable to see and interpret the elaborate system of signals used between players, managers and coaches to implement those strategies. Only the most knowledgeable spectators can fully appreciate every phase of the game as it unfolds on the field. There is no treatise or guide book so concise and so well organized that it could be quickly and effectively consulted during the game to suggest the most effective play under a particular set of circumstance. Such a treatise would be particularly useful to young sport enthusiasts trying to learn the intricacies of a particular game strategy.

SUMMARY OF THE INVENTION

The principal and secondary objects of the invention are to provide a simple, inexpensive and expedient guide to the most effective strategy or play under various sets of circumstances during the development of a team game such as baseball. A guide that can be quickly consulted by a neophyte player or by a spectator. These and other valuable objects are achieved by a simple device made of cardboard or plastic that comprises a frame defining a flat surface having window openings, and a set of mating cards or disks mounted on said frame and bearing a plurality of markings that can be selectively displayed through the windows by sliding or rotating the card or disk in relation to the frame.

A first series of windows are used to dial a set of game conditions such as players or teams position on the field. Instructions applicable to that particular set of game conditions can be read through at least one corresponding window.

DESCRIPTION OF THE PREFERRED EMBODIMENTS OF THE INVENTION

Figure 1:
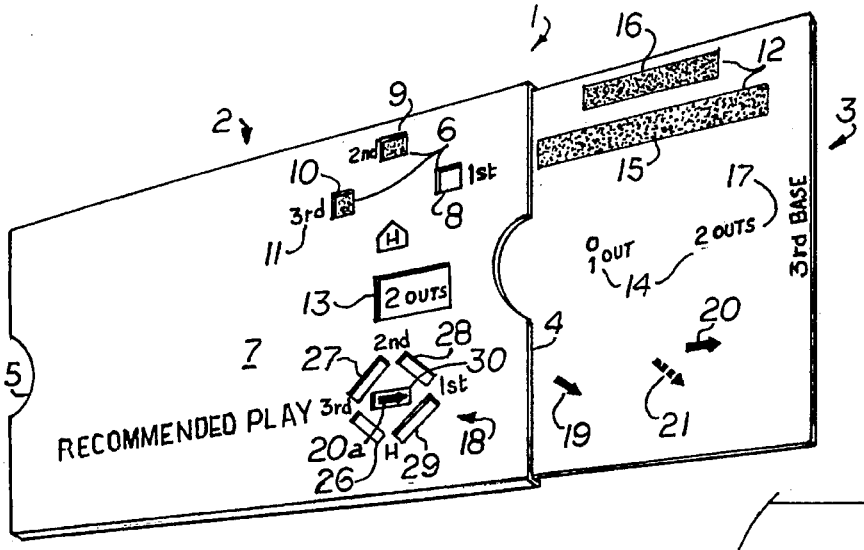
FIG. 1 is a perspective view of a first embodiment of the invention adapted to the game of baseball.

Referring now to the drawing, there is shown in FIG. 1 a baseball play indicator 1 according to the invention. The indicator comprises a frame 2 and a plurality of display cards on which only one 3 is shown in the Figure. The frame 2 consists of a cardboard envelope or sleeve open at both ends 4 and 5. Each card 3 has the same overall dimensions as the frame 2, but is slightly more narrow so that it can be easily passed through the frame. Each card may be made longer than the frame and could even assume the shape of a ribbon. The frame has a first series of windows 6 used to dial the particular conditions of the on-going game. The windows are cut through the upper or cover sheet 7 of the frame. A first set of windows 8, 9, 10 are arranged to form a topographical represention of the first, second and third bases respectively of a baseball diamond field as indicated by the legends 11 printed on the edge of each window. Sets of marks 12 on the display card 3 are sized and located to appear through one of the first set windows 6 as the display card is pushed through the frame 2 in order to indicate various base loading conditions.

A separate window 13 is used to dial the number of applicable outs and/or strikes 14 carried by the card 3.

The card illustrated in FIG. 1 is intended to provide instructions to a third baseman. The two bar marks 15, 16 that appear as part of the fartherest right indicia are designed to show through the windows 8, 9 and 10 to indicate that all bases are loaded under either of two situations indicated in the line 17 below, i.e., after zero or one out, and after two outs.

A second series of windows 18 are used to display recommended actions or game movements by means of pointers or arrow marks printed on the card 3 and appearing between two of any bases.

This second series of windows comprises four apertures 26, 27, 28, 29 and 30 aranged in the general topographical pattern of a baseball diamond by delineating inter-base paths.

For instance, with all bases loaded and zero or one out, an arrow 19 will appear going from the third base toward home base; thus indicating where the third baseman should throw the ball. If the card is pushed further inward to indicate two outs, a first full arrow 20 will appear in the instruction window pointing to first base, and a second arrow 21 in broken lines and pointing to home base will suggest an alternate play.

The indicator is illustrated with the display card inserted to show players on second and third bases after two offense players have been put out. The recommended play indicated by arrow **20*a*** is a throw to first base by the third baseman.

Figure 2:
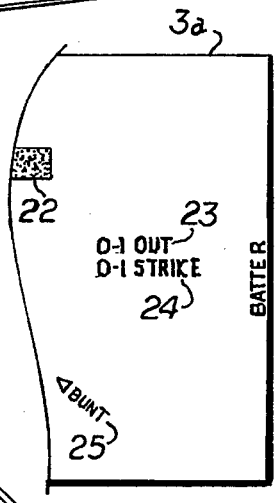
FIG. 2 is a partial top plan view of a display card therefor.

FIG. 2 illustrates a card **3*a* for providing instructions to a batter when one team mate in on third base as determined by bar indicia 22 after zero or one out 23 and zero or one strike 24. The recommendation is a BUNT toward third message 25 that will be displayed in the window 26** between the home and third base.

It should be understood that additional or alternate dialable criteria could be indicated on the device to reflect the player's skill, e.g., his batting average, or another critical factor. Alternately such criteria could be introduced by means of different cards corresponding, for instance, to different levels of a player's skill. Similarly, additional recommendations could be displayed by adding another window in one of the unoccupied areas of the frame. The same combination of windows and indicia can appear on the back of the frame and cards to expand the capacity of the device.

The second set of display windows 18 can also be expanded to show ball paths between the shortstop, the outfielders and the bases.

Such and inexpensive item can carry a promotional message on its unoccupied surface, and be used as an advertising handout.

While the first embodiment of the invention has been illustrated in connection with a game of baseball, similar devices may be implemented for other types of field games and even for table games such as checkers and chess.

Figure 3:
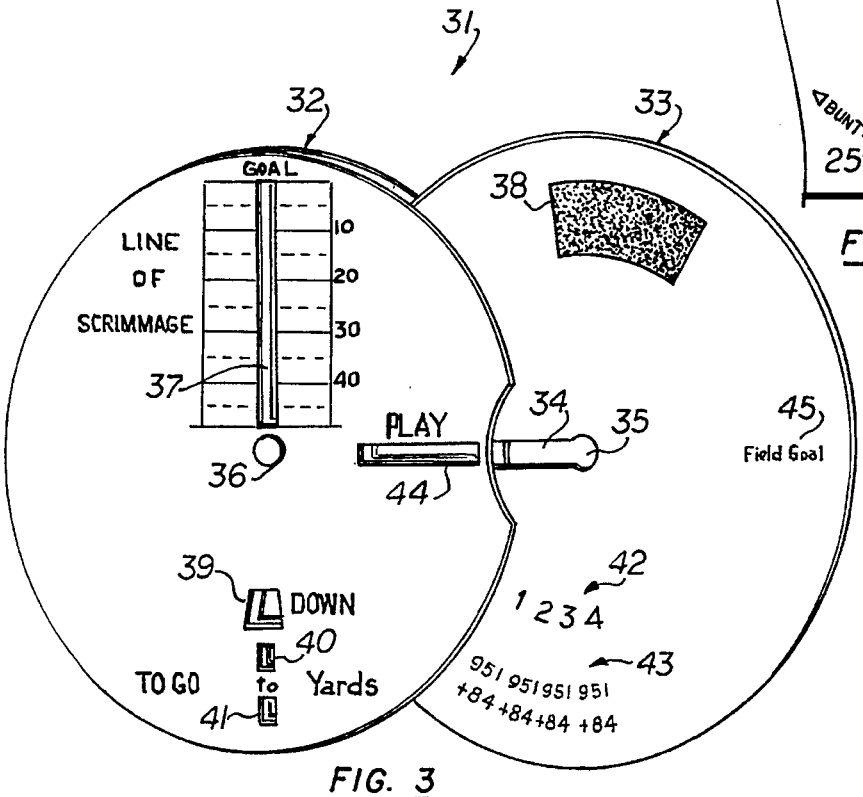
FIG. 3 is a second embodiment of the invention.

The second embodiment 31 of the invention illustrated in FIG. 3 will be described in connection with the game of American football.

In this embodiment, the frame 32 consists of a circular envelope open along one-half of its periphery. The display element consists of a disk 33 commensurate with the inside dimensions of the envelope and having a slot 34 running from a center hole 35 all the way to the peripheral edge of the disk. The slot and central hole are dimensioned to closely match the outer dimension of a rivet or eyelet 36 in the center of the envelope. Once the disk has been inserted into the frame with its central hole 35 bearing against the rivet 36, the disk can be rotated to display indicia printed on both faces through various sets of windows cut through the front and back faces of the frame. An alternate single-faced equivalent of this structure comprises a single-sheet front forming the frame, and a disk display member rotatively and detachably secured to it by a snapping button fastener. In this embodiment the disk is designed to suggest various plays available to an offensive team under various game conditions. The front of the device is intended to carry instructions when the line of scrimmage is in the defense side of the field. The opposite side of the device is used to display instructions when the line of scrimmage is on the offense side of the field.

A first window 37 is used to display the area where the line of scrimmage is located such as, for instance, between the five yard line and the fifty yard line as indicated by the mark 38 on the disk in cooperation with the yardage indications printed along one edge of the window 37. Downs are dialed through a second window 39, and the number of yards to the next first down are dialed through windows 40 and 41. It should be noticed that each down indication 42 remains visible for all applicable yardage indications 43 which are broken down in three dialable positions 1-4, 5-8 and 9 plus. Similarly, the line of scrimmage mark 38 is broad enough to cover the four down situations 42 and consequently, 12 yardage situations 43. A fifth window 44 is used to display the recommended play, in this case a field goal attempt 45.

A plurality of additional conditions and recommendations can be displayed around both faces of the disk of which only one is shown on the drawing for the sake of clarity.

While the preferred embodiments of the invention have been described, modifications can be made and other embodiments may be devised without departing from the spirit of the invention and the scope of the appended claims.

What is claimed is:

1. A device, used in connection with a ball game in which a ball is moved from one location to another on a playing field, for recommending ball moves in response to a plurality of specific game situations, said device comprising:

a frame including a flat top surface having a plurality of windows cut therethrough;

a display member movably mounted on said frame, said member bearing indicia selectively visible through said windows when said member is moved in relation to said frame;

a first set of said windows arranged to display a topographical representation of player locations on said playing field;

a second set of windows arranged to display a topographical representation of paths between player locations on said playing field;

a first set of said indicia comprising a first series of player position marks on said display member selectively visible through said first set of windows to display representations of game situations; and a second set of said indicia comprising a series of arrow marks selectively visible through said second set of windows to display ball movement recommendations for game situation displayed in said first set of windows.

2. The device of claim 1, wherein said player locations are first, second, and third bases of a baseball field.

3. The device of claim 2, wherein said windows further comprises and additional window, and said indicia further comprises representations of the number of outs during a baseball game inning selectively visible through said additional window.

4. The device of claim 2 which further comprises one display member for each of a plurality of player positions.

5. The device of claim 4, wherein each of said display members carries indicia applicable to one player's position.

6. The device of claim 1, wherein:

said frame comprises a quadrangular envelope open at opposite ends; and said display member comprises a card shaped and dimensioned to be slidingly passed through said envelope from one of said ends to the other.

* * * * *